US005859492A

United States Patent [19]

Austad et al.

[11] Patent Number: 5,859,492

[45] Date of Patent: Jan. 12, 1999

[54] ELECTRODE ROD SUPPORT FOR SHORT ARC LAMP

[76] Inventors: Helge Austad, 266 Array Dr., Lebanon, N.J. 08833; Michael T. Burke, 92 Mulberry St., Carteret, N.J. 07008

[21] Appl. No.: 890,702

[22] Filed: Jul. 11, 1997

[51] Int. Cl.[6] ..... H01J 1/88

[52] U.S. Cl. ..... 313/243; 313/623; 313/632; 313/292

[58] Field of Search ..... 313/623, 243, 313/251, 252, 284, 285, 292, 632

[56] References Cited

U.S. PATENT DOCUMENTS

| | | |
|---|---|---|
| 2,562,887 | 8/1951 | Beese . |
| 2,749,461 | 6/1956 | Hierholzer et al. . |
| 2,962,615 | 11/1960 | Anton . |
| 3,211,941 | 10/1965 | Sanden et al. . |
| 3,250,941 | 5/1966 | Wilson et al. . |
| 3,497,752 | 2/1970 | Peterson . |
| 3,715,615 | 2/1973 | Lavering . |
| 4,038,578 | 7/1977 | Mathijssen ..... 313/253 |
| 4,463,281 | 7/1984 | Triebel et al. . |
| 4,481,443 | 11/1984 | Mathijssen ..... 313/636 |
| 4,559,472 | 12/1985 | Triebel et al. . |
| 5,369,329 | 11/1994 | Austad et al. . |

FOREIGN PATENT DOCUMENTS

| | | |
|---|---|---|
| 2106312 | 4/1983 | United Kingdom . |

*Primary Examiner*—Vip Patel
*Attorney, Agent, or Firm*—Kenneth P. Glynn, Esq.

[57] ABSTRACT

The present invention relates to a short arc discharge lamp having a quartz envelope with a bulb and a support for supporting at least one electrode rod within the quartz envelope for specific alignment. The support includes a collar surrounding the at least one electrode rod and being made from a material having a melting point above an operating temperature of the short arc lamp. The collar also has at least one coil spring and at least one placement means for placing at least one coil spring around an outer surface of said collar. Connected to the support is a securing piece for securing the collar to the at least one electrode rod.

20 Claims, 6 Drawing Sheets

ELECTRODE ROD SUPPORT FOR SHORT ARC LAMP

BACKGROUND OF THE INVENTION

1. Field of the Invention

The present invention is directed to support elements for short arc lamp electrode rods. More specifically, such support elements of the present invention include a collar, at least one coil spring and a placement piece for each coil spring and provide significant passage areas for circulation of gas within the arms of the lamp.

2. Information Disclosure Statement

Short arc lamps have been in use for many years and typically involve xenon or other gas within a quartz glass envelope with an anode and cathode separated by a gap across which an arc passes during use. Xenon is particularly useful because it emits a daylight-like light.

The electrodes are attached to electrode rods in opposite positions to each other and these rods extend into quartz arms for contact with electrical connectors. The electrode rods are supported so as to be centrally located axially within the quartz arms, and so as to align the electrodes with one another.

U.S. Pat. No. 5,369,329 by Austad et al. discloses a short arc discharge lamp having a quartz envelope with a bulb and a plurality of arms having a specified cross-section, and wherein one or more electrode rods are supported within the lamp arms for specific alignment. Support elements for the electrode rods are made of high temperature metal and have a flat central portion with a central orifice of sufficient dimension to permit one of the electrode rods to pass into the central orifice, and have at least two legs, and preferably four legs, radially extending from the flat central portion. The legs have outer portions terminating with pods formed at substantially right angles to the flat central portion of the support element, the legs being of sufficient length to fit the support element within a specified cross-section of the envelope arms so as to contact an inside surface of the envelope arms with the pods. There is also provided means for securing the support elements within the envelope arms.

U.S. Pat. No. 4,559,472 describes a discharge lamp or arc lamp with specified support element structures for the electrode rods (referred to as "elongated electrodes"). The high pressure arc lamp described has a quartz glass enclosure defining a discharge space and quartz arms extending away from the discharge space are provided with elongated electrodes (assemblies) extending respectively through the quartz arms. These electrode assemblies carry respective electrodes at their inner ends and the electrode assemblies are sealed hermetically to the respective envelope portion. In order to support the electrodes within the envelope, respective support elements are fitted around the electrodes in spaced relation to the envelope and quartz arms. Means including a respective resilient element engaging each support member, are provided to hold the support elements in their axial position around the respective electrode assemblies. The resilient elements are each held between the respective electrode and the inner surface of the respective support element to continuously urge the axially outer surface of the support element resiliently against the respective inner diameter of the quartz arms.

Unfortunately, the lamp described in U.S. Pat. No. 4,559,472 above retains the gases within the bulbous portions or bulb of the envelope and the sputtering and blackening which occurs limits the illumination and the life of the lamp.

U.S. Pat. No. 4,463,281 describes another arc lamp wherein the electrode rods are supported by spring biased quartz plugs. These plugs are of less mass than the previously described prior art electrode supports and are spring loaded toward the center, with notches or openings cut out for gas to flow through. However, these spaces do not permit or induce significant enough gas flow to substantially reduce the negative sputtering effects described above. In fact, larger cut outs cannot be made without causing or risking cracking or shattering of the glass supports.

U.S. Pat. No. 3,715,616 to Lavering describes and illustrates and an electrode support structure for use in a short arc lamp. The structure includes a ring having a plurality of flaps formed therein. Struts are attached to the electrode and to the flaps. These struts may be straight and may be abutted to the electrode. The flaps can bend to minimize the stresses created by the contraction and expansions of the struts relative to the ring during the temperature cycling of assembly and operation.

U.S. Pat. No. 3,497,752 to Peterson discloses a quartz halogen lamp having a connector coil at the end of a filament leg to physically support the filament and make electrical connection to lead-in wire. The coil encircles the lead-in wire and has two warms in an overlapping, compressive engagement which constricts the coil in its direction of winding and thereby clamps it on the wire. A similar coil, the arms of which press against the lamp envelope, supports the interior end of the filament mount.

U.S. Pat. No. 3,250,941 to Wilson et al. discloses a compact source lamp including a vitreous envelope having a tubular portion, pinch seals at opposite ends of the envelope through which extend inleads each including a foil portion hermetically sealed through the pinch seal and a rod-like portion projecting into the envelope. The electrodes have their outer ends attached to the inner ends of the rod-like portions and define a short interelectrode gap. The foil portion is associated with at least one of the electrodes and is insufficiently rigid to support the electrode vertically. At least one support member comprises a wire coiled around the one electrode at its outer end and has an expanded turn bearing against the wall of the vitreous envelop at the tubular portion.

U.S. Pat. No. 3,211,941 to Sanden et al. describes and illustrates a filament support for tubular incandescent lamps having a support member formed from a single length of wire bent to form a retroverted mid-section which engages the envelop wall and two clamping legs which cross over at least one point adjacent the filament coil and which have clamping portions engaging the filament coil at least at three points around its periphery and which extend divergently therefrom into engagement with the wall of the tubular envelope.

U.S. Pat. No. 2,962,615 to Anton discloses a radiation detector tube including a gastight envelope with a hollow axially symmetrical conducive cathode, a radiation-permeable window sealed across one end of the cathode, an insulator sealed at the other end of the cathode and an anode wire mounted in cantilever fashion and sealed to the insulator. The anode wire extends coaxially within the cathode and terminates adjacent the radiation permeable window. There is also an anode support structure including an insulating sleeve positioned along said anode wire and adjacent the unsupported end of the anode and extending beyond the free tip of the anode, and a support member which engages the insulating sleeve and the cathode to hold the insulating sleeve in fixed positions to prevent the anode from vibrating.

U.S. Pat. No. 2,749,461 to Hierholzer, Jr. et al. relates to electric discharge devices in which a high pressure mercury vapor lamp is resiliently supported inside of an outer envelope of the reflector type wherein the radiations emitted thereby may be directed to a predetermined direction through a dome portion of the outer envelope.

U.S. Pat. No. 2,562,887 to Beese discloses a vapor lamp having an glass envelope resistant to caesium at a range of temperatures with electrodes therein and having a discharge between the electrodes and the envelope upon the application of electrical energy thereto. The envelope is generally cylindrical and includes an ionizable medium.

Great Britain Patent Application No. 2,106,312 A discloses a high pressure discharge lamp with electrodes in relatively long leg parts and having a reinforcement abutment. The reinforcement abutment is a quartz annulus fused to the inside of the leg parts and resilient clips which fit around shanks of the electrodes and bear against the abutments to centrally locate and support the shanks.

Thus, while various supports have been developed for short arc lamp electrode rods, none suggest or teach the present invention collar with coil springs with their configurations and advantages described herein.

SUMMARY OF THE INVENTION

The present invention relates to a short arc discharge lamp having a quartz envelope with a bulb and a support means for supporting at least one electrode rod within the quartz envelope for specific alignment. The support means includes a collar surrounding the at least one electrode rod and being made from a material having a melting point above an operating temperature of the short arc lamp. The collar also has at least one placement means for placing at least one coil spring around an outer surface of said collar; Connected to the support means is a securing means for securing the collar to said at least one electrode rod.

BRIEF DESCRIPTION OF THE DRAWINGS

The present invention is more fully understood when the specification herein is taken in conjunction with the drawings appended hereto. They are as follows.

DETAILED DESCRIPTION OF THE PRESENT INVENTION

The present invention is directed to an improved short arc discharge lamp which has one or more support elements to hold electrode rods in their proper aligned positions within the lamp envelope arms. Thus, it is an object of the present invention to arrange the support element in such a way that it can be held in its proper axial position relatively simply.

Briefly, in accordance with the present invention, a short arc discharge lamp having a quartz envelope defining a discharge space and envelope portions extending away from the discharge space, referred to as "arms", is provided with electrode rods extending respectively through the envelope arms. These electrode rods carry at their inner end portions respective electrodes facing one another within the discharge space, and conventional means are used for interconnecting outer end portions of the electrode rods and respective envelope arms for sealing the electrode rods hermetically within the envelope portions. In order to support the electrode rods within the envelope arms, respective support elements are used with each electrode rod in spaced relation to the envelope arms, and resilient retaining or securing means are provided which resiliently engage each support element, for holding the support elements in their axial positions around respective electrode rods.

The support element includes a collar and at least one coil spring surrounding an outer edge of the collar an being held in place by a placement means. The collar is made from a material having a melting point higher than the operational temperature of the lamp. Such material may be quartz, ceramic, high temperature glass or compatible material.

The placement means may be a groove in the collar with a diameter less that the diameter of the collar. A securing means secures the collar on the electrode rod.

Many conventional arc displacements have significant disadvantages and among these is the fragileness of using glass inserts, the problem of occupying substantial space within the arms of the envelope, the containment of xenon primarily in the bulb area and the weight factor which may be involved in larger units. Most significantly, the prior art arrangement contains the xenon gases within the bulb position of the envelope and, during usage, sputtering occurs and blackening coats the inside of the bulb. This eventually results in blackening of the bulb to the point where it must be replaced. Further, prior to replacement, such prior art bulbs have decreased illumination due to the gradual buildup of blackening within the bulb portion of the lamp.

Figure 1:
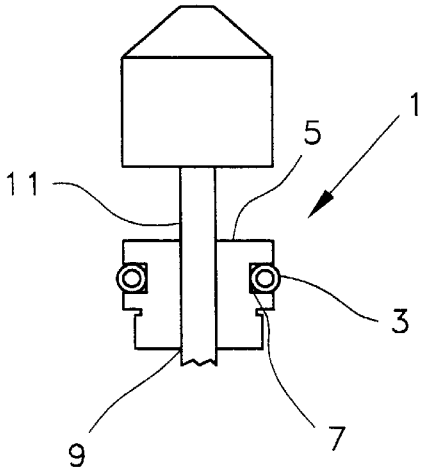
FIG. 1 shows a front cut view of a support element having one coil of the present invention.

Referring now to the Figures, there is shown in FIG. 1 a front cut view of a support element 1 having one coil spring 3 of the present invention. This support element is configured to receive a cylindrical electrode rod but could readily be adapted to receive an electrode rod of a cross-section other than circular. However, since electrode rods for short arc discharge lamps are typically cylindrical, the support elements described herein are shown as cylindrical but should not be viewed to be limited as such.

The support element 1 includes a collar 5 having placement means 7 for placing the coil spring 3 around an outer surface of the collar 5 and surrounds electrode rod 11. The collar 5 has an orifice 9 of sufficient diameter to receive an electrode rod therethrough. The placement means 7 may be a groove around an outer edge of the collar 5 for placing the coil spring 3.

The collars of the present invention should be constructed of a material that has a melting point higher than the operational temperature of the lamp such as quartz, ceramic, high temperature glass, a compatible metal or the like. The compatible metals, which will not melt or distort at typical short arc discharge lamp envelope arm temperatures, are molybdenum or molybdenum alloys, tantalum, titanium, etc.

Figure 2:
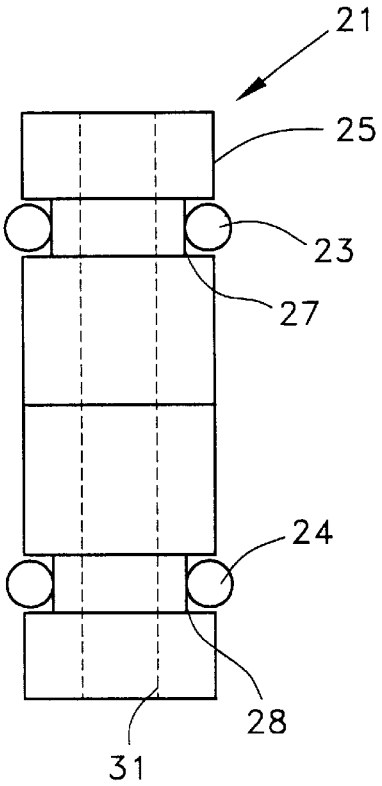
FIG. 2 shows a front view of a support element having two coils of the present invention.
Figure 3:
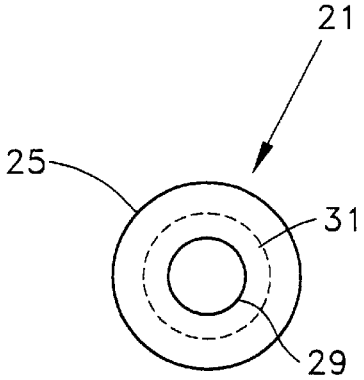
FIG. 3 shows a top view of the support element shown in FIG. 2.

FIGS. 2 and 3 show a front and top view, respectively, of a support element 21 having two coil springs 23, 24 of the present invention. This support element is configured to receive a cylindrical electrode rod but could readily be adapted to receive an electrode rod of a cross-section other than circular.

The support element 21 includes a collar 25 having placement means 27, 28 for placing the coil springs 23, 24 around an outer surface of the collar 25 and surrounds electrode rod 31. The collar 25 has an orifice 29 of sufficient diameter to receive an electrode rod therethrough. The placement means 27, 28 may be a groove around an outer edge of the collar 25 for placing the coil spring 23, 24.

The support elements 1, 21 shown in FIGS. 1, 2 and 3 may typically be placed around a rod 11, 31 and be held in place by a securing means. The securing means may include a spring and retainers attached to the rod. The rod itself could also have securing beads of quartz or glass so as to hold the support elements 1, 21 axially, Further, springs tightly wrapped about the electrode rod on which support element 50 may be utilized could prevent (movement of the support element with respect to the electrode. Other securing means should now be evident to the artisan without exceeding the scope of the invention.

Figure 4:
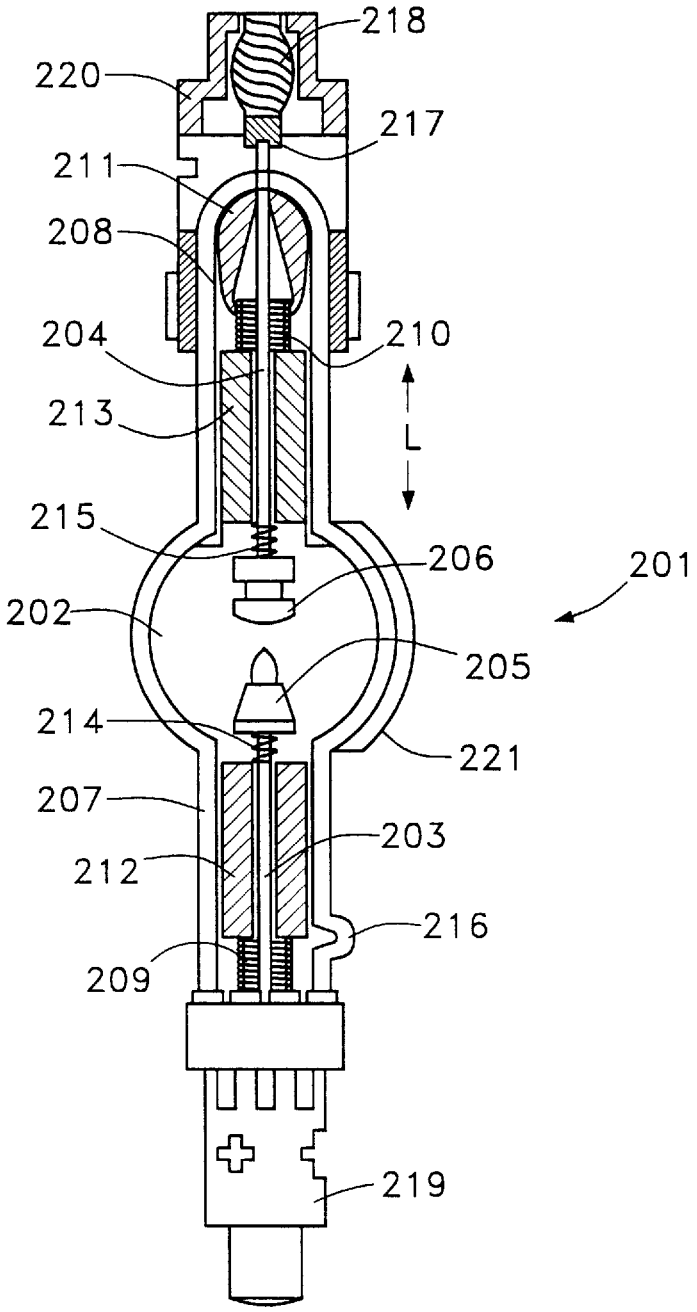
Fig. 4 (PRIOR ART)
FIG. 4 shows a side cut view of a short arc discharge lamp of the prior art.
Figure 5:
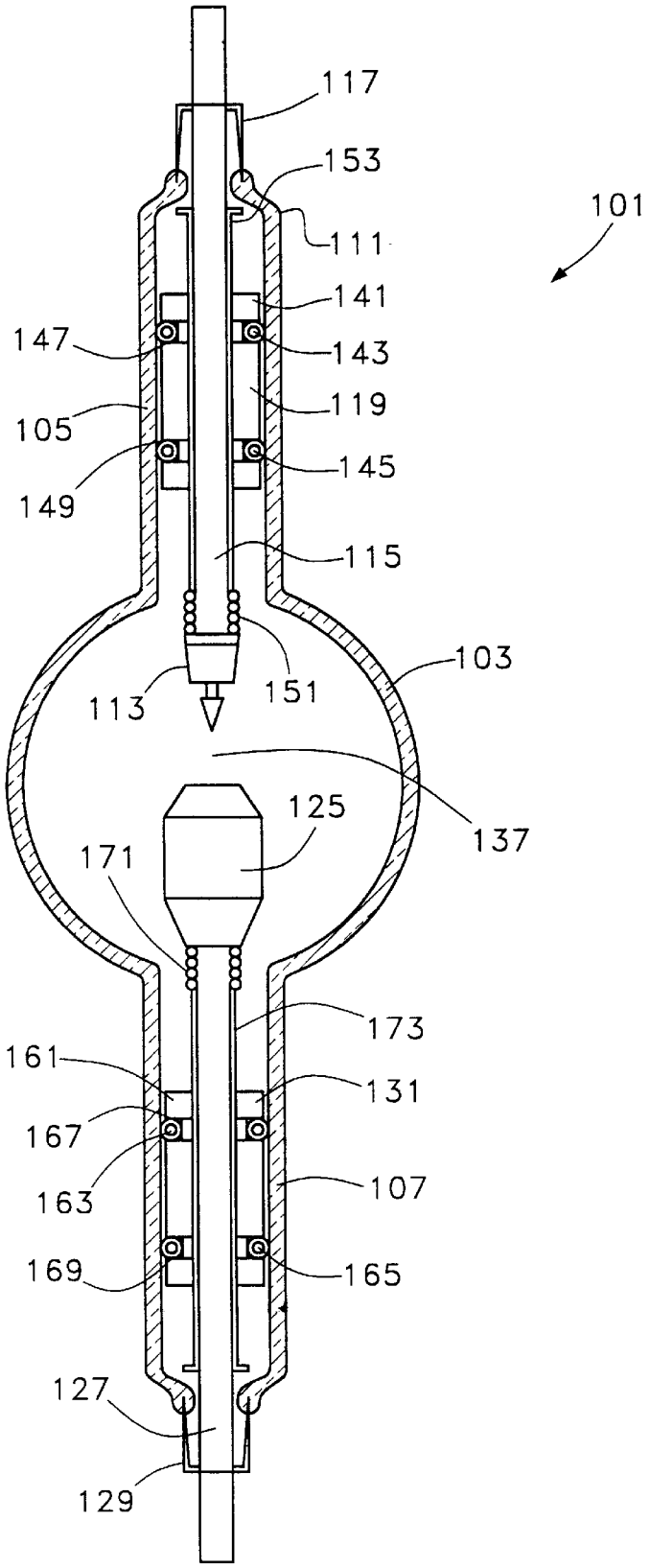
FIG. 5 shows a present invention short arc discharge lamp using support elements for anode and cathode support.

FIG. 4 shows a prior art configuration which is described as follows:

The high-pressure discharge lamp 201 shown if FIG. 5 includes a glass enclosure formed by quartz glass to define a generally globular discharge space 202 and cylindrical envelope portions 207 and 208. Extending concentrically within the envelope portions 207 and 208 are electrode rods 203 and 204 carrying, respectively, an cathode 205 and a anode 206 at their inner ends. The outer ends of the electrode rods 203 and 204 are sealed hermetically to the outer ends of the envelope portions 207 and 208. The hermetic seal comprises the glass members 209 and 210, respectively, a dome portion 211 the envelope portions 207 and 208.

Support elements, each formed by respective tubular members 212 and 213, are fitted around the electrode rods 203 and 204. The support elements are preferably also formed of quartz glass, but may be formed of a ceramic material, or the like, and have a diameter enabling a small clearance to be maintained between the support elements and the inner surface of the respective envelope portions. These support elements 212 and 213 are urged against the respective glass members 209 and 210 by a retaining element formed as a respective spiral compression spring 214 and 215 preferably formed of the same material as the electrode rods 203 and 204, that is tungsten. These springs 214 and 215 are arranged between the cathode 205 and the anode 206, respectively, and the respective support elements 212 or 213.

The support element 212 has a length L of about 25 mm, and the support element 213 has a length L. of about 20 mm, and both support elements have a diameter D of about 7.5 mm. The ratio of the length L to diameter D of the support elements of the embodiment illustrated in FIG. 2 remains substantially constant over the entire length of the support element, that is for the support element 212 on the cathode side, this ratio is approximately 3.33; and for the support element 213 on the anode side, the ratio is approximately 2.67. The electrode rod 204 extends externally from the hermetic seal and is connected by intermediate member 217 to a stranded lead-in-wire 218, held in base 220, and base 219 connects an end portion of electrode rod 203 with appropriate electrical connectors. A starting wire 221 is passed along the discharge space 202 on the outside thereof and is wrapped around respective envelope portions 207 and 208. The high pressure discharge lamp of FIG. 4. is typically charged with xenon gas to a pressure of about 10 bar through opening 216 which is later sealed, and is operated from a D.C. source with an input of approximately 500 W.

Support elements 212 and 213 of tile prior art discharge lamp 201 have significant disadvantages and among these is the fragileness of using glass inserts, the problem of occupying substantial space within the arms of the envelope, the containment of xenon primarily in the bulb area and the weight factor which may be involved in larger units. Most significantly, this type of prior art arrangement contains the xenon gases within the bulb position of the envelope and, during usage, sputtering occurs and blackening coats the inside of the bulb. This eventually results in blackening of the bulb to the point where it must be replaced. Further, prior to replacement, such prior art bulbs have decreased illumination due to the gradual buildup of blackening within the bulb portion of the lamp.

Referring now to FIG. 5, there is shown present invention short arc discharge lamp 101 with bulb portion 103 and envelope arms 105 and 107. Anode 113 is located within the bulb portion 103 and is attached to electrode rod 115 which extends through envelope dome 111 and base attachment piece 117 and may have additional base attachments for wiring which are conventional and not a point of novelty as to this particular invention.

Present invention support element 119 similar to that shown in FIG. 2 is located on electrode rod 115 and has a collar 141 and coil springs 143, 145. Coil springs 143, 145 are held around collar 141 in place by placement means 147, 149, respectively. Support element 119 is secured by a positioning means, in this case, a spring 151 and a retainer 153 holding it in position to prevent it from sliding axially upwardly or downwardly. Additionally, the coil springs 143, 145 of support element 119 are directly in contact with the inside surface of arm 105, as shown.

Further anode 125 is located within bulb portion 103 and is spaced so as to create arc gap 137 between it and cathode 113. Anode 125 is attached to electrode rod 127, which has a support element 131 surrounding a portion thereof. Support element 131 has a collar 161 and coil springs 163, 165. Coil springs 163, 165 are held around collar 161 in place by placement means 167, 169, respectively. Electrode rod 127 extends through base attachment 129, as shown. Support element 131 is secured by a securing means, in this case, a spring 171 and retainer 173 holding it in position to prevent it from sliding axially upwardly or downwardly. Additionally, the coil springs 163, 165 of support element 131 are directly in contact with the inside surface of arm 107, as shown, and is held in place axially via placement means including spring 171 and retainer 173. Again, the support element is in direct contact with the inside surfaces of the walls of envelope arm 107.

The present invention discharge lamp 101 with the advantageous support elements 119 and 131 allow xenon gas to enter into the full length of the envelope arms 105 and 107 in substantial amounts. As can be seen, xenon gas fed through a fill tube (not shown) near the lower end of arm 107 will flow up around the support element 131. When discharge lamp 101 is operated, the sputtering which occurs will result in deposition primarily on the quartz surfaces of the arms rather than bulb portion 103 as such deposition occurs at the coolest points within the lamp. This allows the lamp of the present invention, discharge lamp 101, to operate brighter and also longer than conventional prior art lamps. Thus, the present invention lamp and present invention support elements create the synergistic effects of decreasing weight, decreasing likelihood of breakage and, at the same time reducing the problems created by sputtering as well as extending the useful life of the lamps and having the lamps operate with more light passing therethrough, i.e. with greater illumination.

Figure 6:
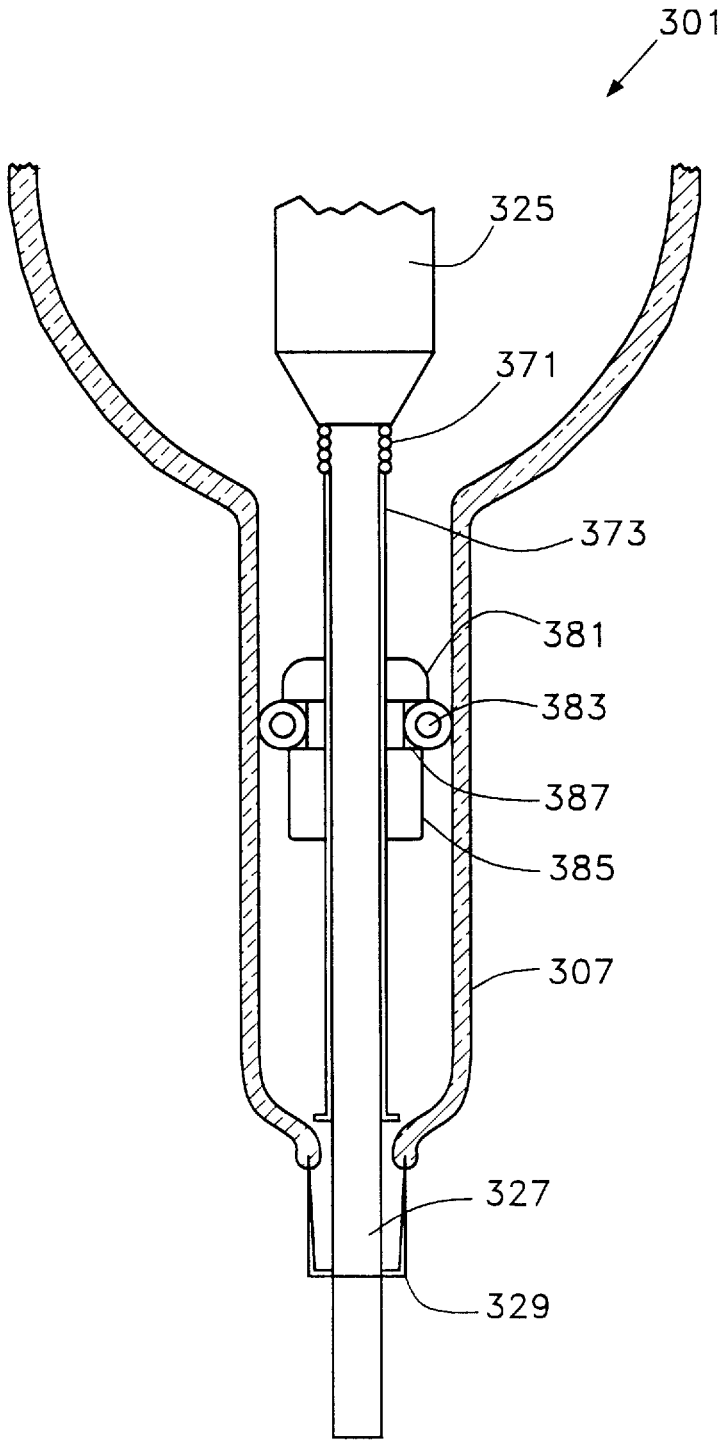
FIG. 6 shows a partial view of another embodiment of the present invention having a support element with one spring coil.

FIG. 6 shows a partial view of an alternative embodiment of a present invention lamp 301. Lamp 301 is similar to the lamp described by FIG. 5, but, in this case, support element 381 has just one coil spring 383 and just the anode arm is shown. Like parts are similarly numbered as in FIG. 5, but beginning with "300".

The support element 381 includes a collar 385 and coil spring 383. The collar 385 has placement means 387 which permits the coil spring 383 to remain placed around the collar 385. The advantages here are similar to those achieved in the present invention lamp 101 described above.

Figure 7:
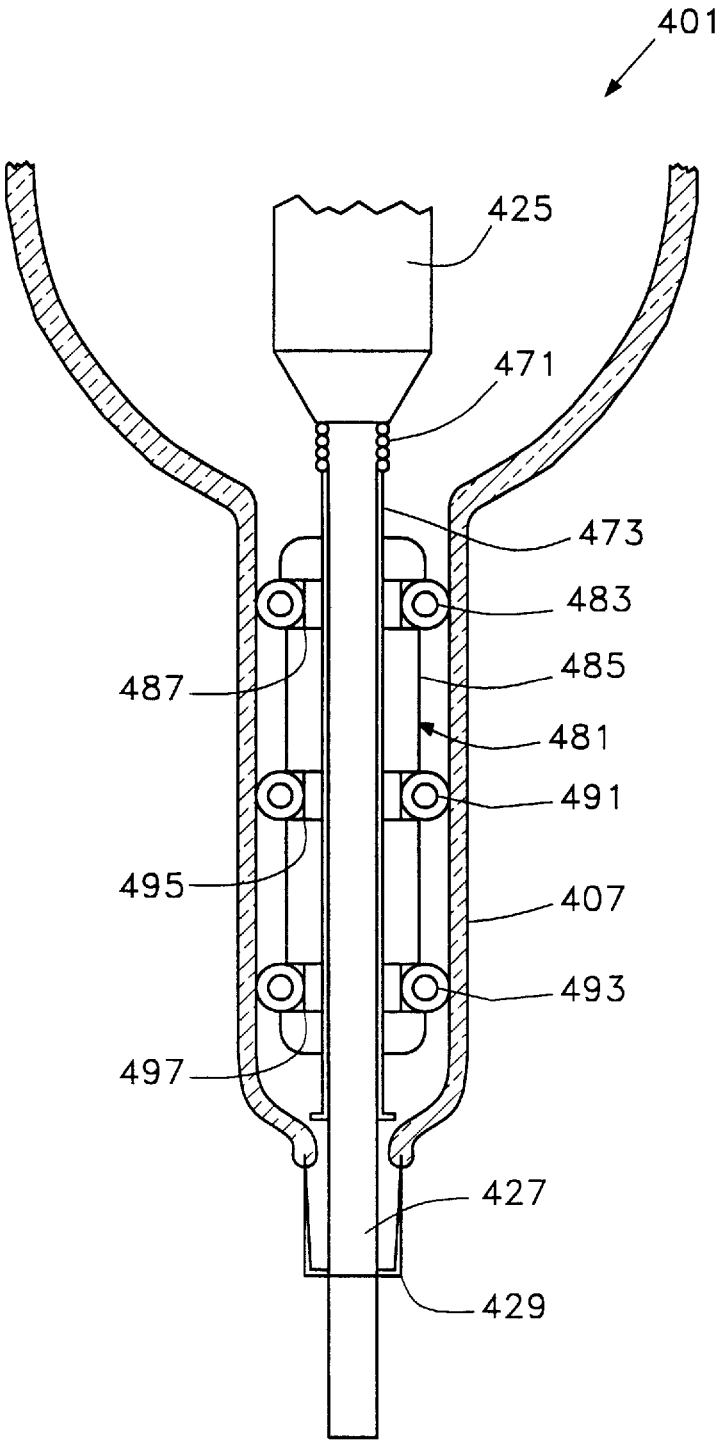
FIG. 7 shows a partial view of another embodiment of the present invention having a support element with three spring coils.

FIG. 7 shows a partial view of an alternative embodiment of a present invention lamp 401. Lamp 401 is similar to the lamp described by FIG. 5, but, in this case, support element 481 has three coil springs 483, 491, 493 and just the anode arm is shown. Like parts are similarly numbered as in FIG. 5, but beginning with "400".

The support element 481 includes a collar 485 and coil springs 483, 491, 493. The collar 485 has placement means 487, 495, 497 which permit the coil springs 483, 491, 493 to remain placed around the collar 485. The advantages here are similar to those achieved in the present invention lamp 101 described above.

Figure 9:
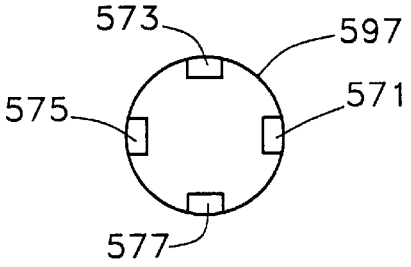
FIG. 9 shows a top view of a foil seal on a base of the present invention depicted in FIG. 8.
Figure 8:
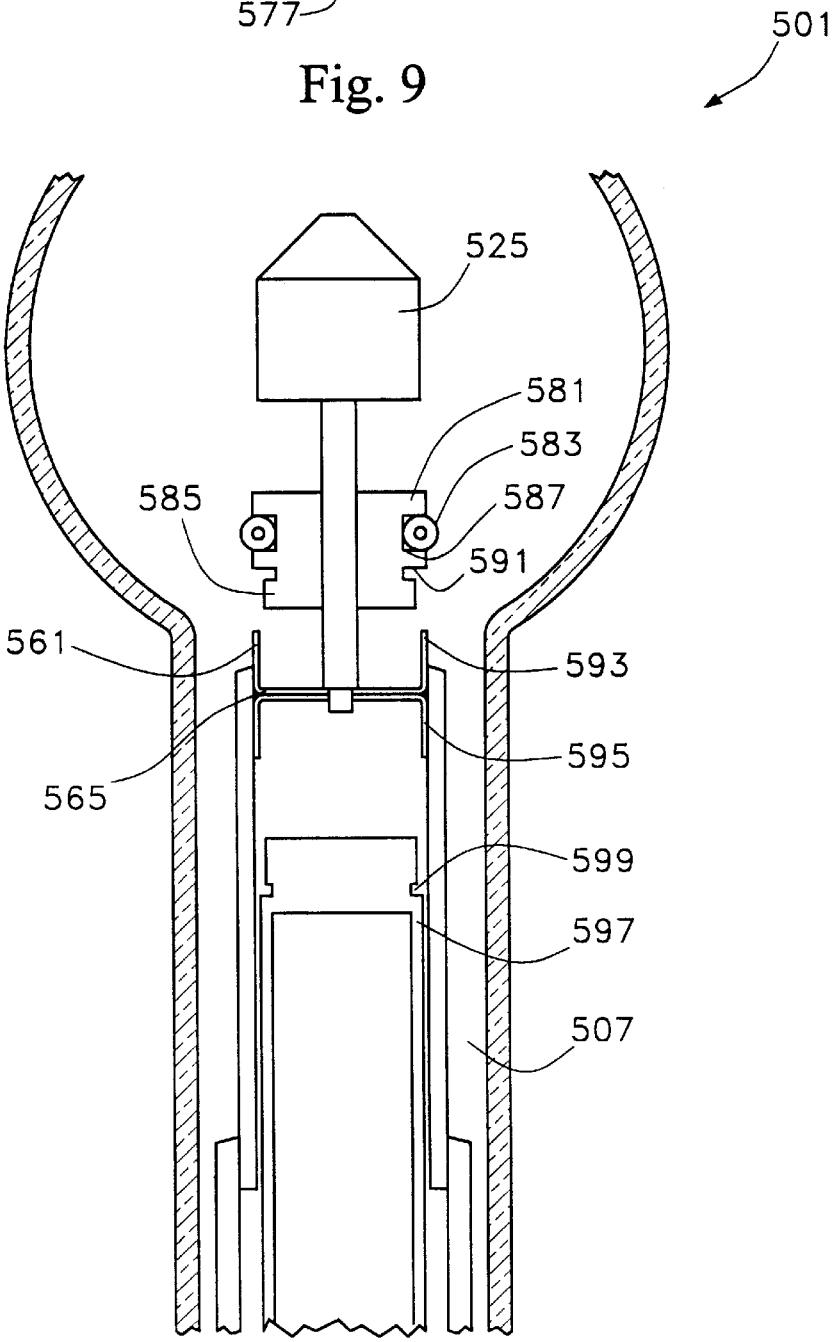
FIG. 8 shows a partial exploded view of another embodiment of the present invention having a support element with one spring coil attached with an alternate securing means.

Referring now to FIGS. 8 and 9, there is shown a present invention short arc lamp 501 having a molybdenum cup seal. FIG. 8 shows a pair of cups 593, 595 exploded over a base of the device 597 and a support elemtent 581 exploded over the pair of cups 593, 595.

Each cup 593, 595 is a hard ductile acid resistant element of the vanadium family, such as tantalum and includes a sidewall 561 and a bottom 565. The cups are placed so that the bottoms of each cup 593, 595 rest upon each other. Cup 593 fits into an aperture 591 in a collar 585 of the support element 581. Cup 595 fits into an aperture 599 in the base 597. Together the placement of the cups 593, 595 into the apertures 591, 599 secure the support element 581 on an electrode rod 527. A plurality of foil 571, 573, 575, 577 is placed in strips over the base 597 in order to facilitate electrical conduction.

The cups 593, 595 with the foil seal keep mercury and xenon in the bulb portion 503 and out of the envelop arm 507. Without this setup, mercury would float to the envelop arm 507 because it is cooler.

As can be seen by observing FIGS. 5, 6, 7 and 8, there is at least one coil spring and the number of coil springs in the anode arm do not have to match the number of coil springs in the cathode arm of the lamp. Furthermore, while one, two or three coil springs were illustrated, there can be more than three coil springs in each arm.

The multiple coil supports of the present invention are particularly useful in supporting heavy units, as in the case where some anode heads weigh as much as 14 to 16 ounces or more. Since the size of the anode and cathode head increases with higher power lamps (i.e., 1 kw, 2 kw . . . 12 kw), the weight of the head is proportional to its size. Therefore larger size heads require more support.

Quartz supports such as are found in the prior art may crack and do crack during shipping of such lamps. Unobserved cracks result in utilization of lamps which may explode during use from Thermal expansion. These problems are eliminated by the present invention.

Obviously, numerous modifications and variations of the present invention are possible in light of the above teachings. For example, there may be more than three coils in the support element. It is therefore understood that within the scope of the appended claims, the invention may be practiced otherwise than as specifically described herein.

What is claimed is:

1. A short arc discharge lamp which comprises:

(a) a quartz envelope having a bulbous portion; and (b) support means for supporting at least one electrode rod within said quartz envelope for specific alignment, said support means including:

(i) a collar surrounding said at least one electrode rod and being made from a material having a melting point above an operating temperature of said short arc discharge lamp and having at least one placement means for placing at least one coil spring around an outer surface of said collar;

(ii) said at least one coil spring surrounding said at least one placement means and contacting an inside surface of said envelop; and (iii) securing means for securing said collar to said at least one electrode rod.

2. The short arc lamp of claim 1, wherein said material is selected from the group consisting of quartz, ceramic, high temperature glass or compatible metal.

3. The short arc lamp of claim 1, wherein a number of said at least one coil spring is one.

4. The short arc lamp of claim 1, wherein a number of said at least one coil spring is two.

5. The short arc lamp of claim 1, wherein a number of said at least one coil spring is three.

6. The short arc lamp of claim 1, wherein said securing means includes a spring loaded to at least one retainer extending from said electrode rod.

7. The short arc lamp of claim 1, wherein said securing means includes a pair of cups connected to apertures in said support element and base of said short arc lamp.

8. The short arc lamp of claim 1, wherein said at least one placement means is a circular groove on an outer surface of said collar.

9. The short arc lamp of claim 8, wherein a diameter of said circular groove is less than a diameter of said collar.

10. The short arc lamp of claim 7, wherein each cup is made from tantalum.

11. A short arc discharge lamp which comprises:

(a) a quartz envelope having a bulbous portion;

(b) a plurality of electrodes spaced apart from one another within said envelope so as to create a short arc discharge space between them and within said bulbous portion;

(c) an electrode rod connected to each of said electrodes and being within said discharge space; and (d) a support means for supporting said electrode rod within said quartz envelope for specific alignment including:

(i) a collar surrounding said at least one electrode rod and being made from a material having a melting point above an operating temperature of said short arc discharge lamp and having at least one placement means for placing at least one coil spring around an outer surface of said collar;

(ii) said at least one coil spring surrounding said at least one placement means and contacting an inside surface of said envelop; and (iii) securing means for securing said collar to said at least one electrode rod.

12. The short arc lamp of claim 11, wherein said material is selected from the group consisting of quartz, ceramic, high temperature glass and compatible metal.

13. The short arc lamp of claim 11, wherein a number of said at least one coil spring is one.

14. The short arc lamp of claim 11, wherein a number of said at least one coil spring is two.

15. The short arc lamp of claim 11, wherein a number of said at least one coil spring is three.

16. The short arc lamp of claim 11, wherein said securing means includes a spring loaded to at least one retainer extending from said electrode rod.

17. The short arc lamp of claim 11, wherein said securing means includes a pair of cups connected to apertures in said support element and base of said short arc lamp.

18. The short arc lamp of claim 11, wherein said at least one placement means is a circular groove on an outer surface of said collar.

19. The short arc lamp of claim 18 wherein a diameter of said circular groove is less than a diameter of said collar.

20. The short arc lamp of claim 17, wherein each cup is made from tantalum.

* * * * *